United States Patent [19]

Spillers et al.

[11] Patent Number: 4,762,257

[45] Date of Patent: Aug. 9, 1988

[54] HOSE HANDLER

[75] Inventors: Robert L. Spillers; Alonzo Martinez, both of Freeport; Vergel G. Perry; Lonnie L. Smith, Both of Lake Jackson, all of Tex.

[73] Assignee: Larvco, Inc., Lake Jackson, Tex.

[21] Appl. No.: 926,883

[22] Filed: Nov. 5, 1986

Related U.S. Application Data

[63] Continuation of Ser. No. 737,685, May 28, 1985.

[51] Int. Cl.[4] ..... A45F 3/04

[52] U.S. Cl. ..... 224/216; 224/250; 224/904

[58] Field of Search ..... 224/150, 215, 216, 225, 224/232, 250, 251, 252, 253, 269, 903, 904, 914; D2/405, 630

[56] References Cited

U.S. PATENT DOCUMENTS

| | | | |
|---|---|---|---|
| 860,395 | 7/1907 | Lindsey | 224/216 |
| 1,010,763 | 12/1911 | Hogan | 224/904 |
| 2,075,451 | 3/1937 | Mix | 224/903 |
| 2,388,811 | 11/1945 | Zatko | 224/225 X |
| 3,184,883 | 5/1965 | McCook | 224/214 X |

*Primary Examiner*—Henry J. Recla
*Assistant Examiner*—David Voorhees
*Attorney, Agent, or Firm*—Pravel, Gambrell, Hewitt, Kimball & Krieger

[57] ABSTRACT

The Hose Handler to enable a fireman to carry a firehose without use of his hands consists of a detachable chest belt further supported by a pair of shoulder straps. One or more quick-release latches are attached to the chest belt in the regions between the attachments points for the shoulder straps, to which a lanyard supporting a firehose can be readily attached or detached.

15 Claims, 1 Drawing Sheet

HOSE HANDLER

This is a continuation of co-pending application Ser. No. 737,685 filed on May 28, 1985.

BACKGROUND OF THE INVENTION

One of the most difficult aspects of fire fighting is the support and control of the firehose, especially when the fire fighter is on a ladder or in any other situation in which one or more of his hands is occupied.

Firehoses are not only heavy, but quite unwieldy when charged with the pressures typically used to deliver water onto the fire. To direct their output onto the fire requires both skill and strength. The strength requirement increases significantly when the firefighter must ascend a ladder to fight the fire. Fatique in the arms and hands frequently becomes a factor in affecting the firefighter's performance. The hazard of handling the pressurized hose together with the fatigue resulting from having to both support and direct the hose present a safety risk to the firefighter. Additional hazard and inefficiency results from the firefighter having at least one hand preoccupied with the hose, requiring him, for example, to climb a ladder with only one arm and hand available to support him.

These problems could be solved if an apparatus could be devised which permits the firefighter to support his firehose without fatiguing his arms and hands and without preoccupying his hands from other work.

Murnan (U.S. Pat. No. 593,901) shows a fireman's tool and hose carrier wherein a tool is latchable directly to a belt. This apparatus provides a single shoulder strap, a conventional tongue/hole buckle, and the tool is attached directly to the belt at a fixed side position.

Van Winkle (U.S. Pat. No. 2,095,351) has shown a self-contained painter's apparatus which may be attached to a painter's back.

Twaits (U.S. Pat. No. 3,034,596) has shown a quick release latching device for shoulder and waist straps, which device could be used with any harness mechanisms where a quick release feature is desired.

Lovering (U.S. Pat. No. 3,064,074) devised a hunter's coat with an internally fixed tow harness to which a tow line could be attached.

Hutchinson (U.S. Pat. No. 3,973,643) shows a detachable harness which may be snapped on to a jacket or coat and buckled around the waist of same, to which a towing harness is attached to the wearer's backside.

Himmelrich (U.S. Pat. No. 4,076,101) presents a utility coat with a seating apparatus adapted to the wearer's being raised or lowered by a line.

SUMMARY OF THE INVENTION

In this invention a detachable chest belt fitted with a releasable fastener in the front is attached to and supported by a shoulder harness consisting of a pair of crossed shoulder straps which slip over the wearer's shoulders. The chest belt is provided with a slideable quick release latch at points beneath the shoulders to which a lanyard with a mating tongue is attached. The other end of said lanyard is attached to a firehose or other item to be supported. Either or both the lanyard and the harness itself may be discarded readily if required.

DESCRIPTION OF A PREFERRED EMBODIMENT

Figure 1:
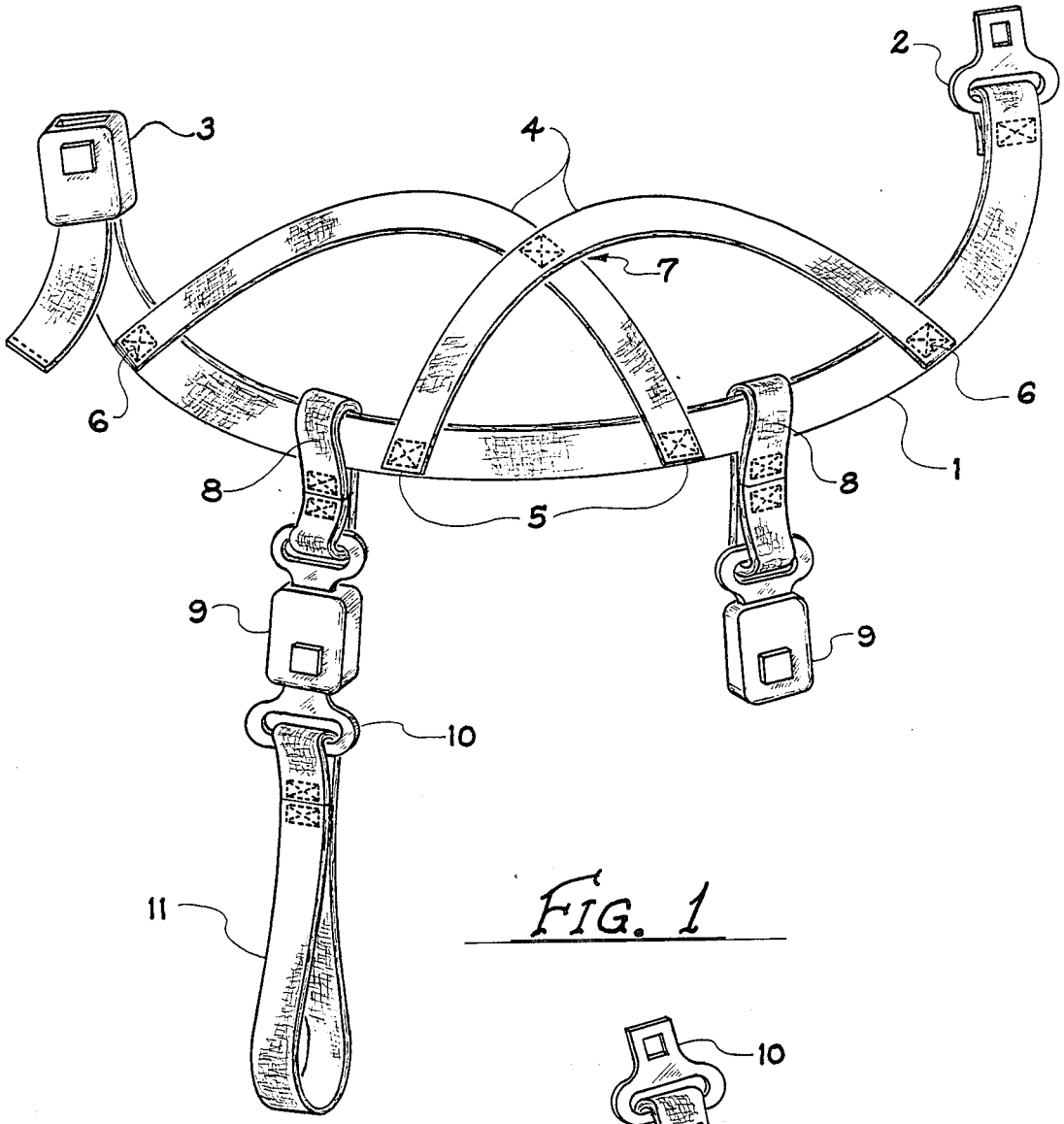
FIG. 1 presents an artist's rendition of the Hose Handler when detached from the wearer and the firehose.

Referring to FIG. 1, the Hose Handler comprises the chest belt (1) of nylon webbing or similar material for providing flexibility, durability, and strength. To the opposite ends of the chest belt are fitted a tongue (2) and latch (3) for releasably receiving tongue. The attachment to either or both the tongue and latch is desirably made adjustable by means of any of a number of well known techniques. To the chest belt are attached two shoulder straps (4). The connections of the straps to the chest belt (5, 6) are desirably sewn, but could be attached by a latch or other fastener. Criss-crossing the straps perpendicularly (7) as shown enhances the strength and shâpe retentiveness of the overall harness. Desirably, the straps are sewn or otherwise attached to one another at the point where they cross one another. At one or more points (8) is attached a loop of belt or similar material to which a latch (9) is affixed for receiving a snap (10). Alternatively, the latch (9) can be affixed directly to the belt (1) at said points of attachment (5, 6). To the tongue (10) is attached the lanyard (11) for supporting a firehose. It is often useful for the lanyard to consist of a loop of belt or line, and to be attached to the tongue (10) with a device permitting its length to be adjusted.

Although points (8) could be fixed on the belt (1) in a permanent position, optimum support and stability are obtained when the points of attachment (8) are slideable between the shoulder strap connection points (5) or (6), so that a load distributes itself evenly relative to the wearer's body.

The artisan will appreciate that the relative positions of the latch (9) and the tongue (10) may be reversed. It is considered optimum to have the latch (9) attached to the belt, however, from the viewpoint that the lanyard can be most easily attached and detached in this configuration. Use of standard tongue and latch configurations facilitates universal use by firefighters in different geographical locations.

Figure 2:
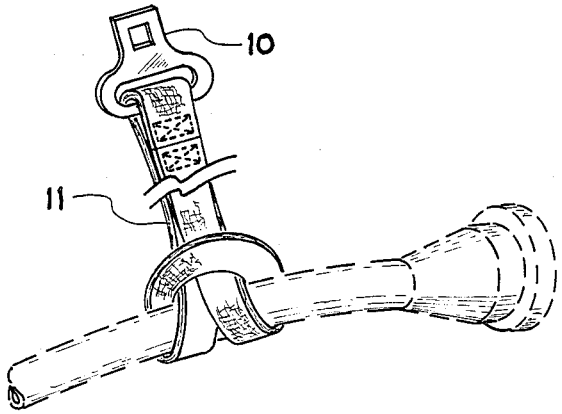
FIG. 2 presents an artist's rendition of the means by which the lanyard of the Hose Handler can be used to support a firehose.

Referring to FIG. 2, in a typical embodiment the tongue (10) is the same as used on the belt as shown in FIG. 1, and the lanyard could be looped around the firehose as shown.

With the Hose Handler fitted to the firefighter, the lanyard is attached, and the firehose is either extended through the lanyard's loop, or is otherwise attached to the lanyard. The firefighter can now walk, climb or perform other activities and the firehose will be supported by the firefighter's shoulders. His hands and arms are free to grip a ladder or guide the nozzle of the firehose. The firefighter need not use his arms and hands to push forward the nozzle to counteract the thrust of the nozzle discharge. The nozzle thrust is distributed over the firefighter's entire body, especially his legs, greatly reducing fatigue. In addition, the risk of dropping the hose is minimized. It is well known that an unrestrained hose will whip about violently, presenting a serious hazard to the firefighter and other personnel in the area. With the use of the Hose Handler, even is the firefighter were to fall down, the hose would not come loose and become a hazard. Should the hose need to be disengaged rapidly, the tongue (10) can be readily released from the latch (9).

We claim:

1. A fire fighter's harness comprising:

a chest belt fitted with means for releasably fastening the belt at the front of the wearer;

a lanyard;

a pair of should straps attached to said belt at front and rear attachment points; and tongue and latch means for releasably attaching said lanyard to said belt, said tongue and latch means being attached to said belt, being laterally slidable under the arm of the wearer behind a said front attachment point and a said rear attachment point of said straps and adapted to cooperate with said belt and shoulder straps to distribute between said front and rear attachment points a load supported by said lanyard, said tongue and latch means being readily releasable under tension said tongue and latch means including a push button actuator and being readily releasable when under tension to detach said lanyard from said belt by mere pressure on said actuator.

2. The harness of claim 1, wherein said shoulder straps cross in the back and are attached to each other at a common point.

3. The harness of claim 1, wherein said straps are fixedly attached to said chest belt at said front and rear attachment points.

4. The harness of claim 1, wherein said lanyard attaching means includes a loop slideably positioned on said chest belt.

5. The harness of claim 1, wherein said tongue and latch means includes a tongue attached to said lanyard and a latch attached to said loop for releasably receiving said tongue.

6. The harness of claim 1, wherein said lanyard is adapted to support a firehose.

7. The harness of claim 6, wherein the length of said lanyard is adjustable.

8. The harness of claim 1, wherein said belt is adjustable.

9. The harness of claim 1, wherein said belt fastening means is readily releasable under tension.

10. The harness of claim 9, wherein said belt fastening means includes at opposite ends a tongue and a latch for releasably receiving said tongue.

11. A harness for supporting a high pressure hose discharging water through a nozzle, comprising:

an adjustable belt encircling the chest of the wearer and including releasable means for fastening opposite ends of said belt; a pair of crossing shoulder straps having respective front and rear portions fixedly attached to said belt;

a lanyard secured to the hose; and means for releasably attaching said lanyard to said belt, said attachment means being laterally slidable to a position on said belt at one side of the wearer to distribute loading from the weight of the hose and the force of the nozzle discharge between said front and rear portions of said shoulder straps and between the shoulders of the wearer, said lanyard attaching means including a loop around said belt, a tongue attached to said lanyard, and a latch for receiving said tongue, said tongue being readily releasable from said latch under said loading of the hose and nozzle discharge said lanyard attaching means including a loop around said belt, a tongue attached to said lanyard, and a latch attached to said loop for receiving said tongue including a push button actuator for being readily releasable from said latch by mere pressure on said actuator when said lanyard is under said loading of the hose and nozzle discharge.

12. The harness of claim 11, wherein said belt fastening means includes a tongue and a latch for receiving said tongue, said tongue and latch being readily releasable while the harness is supporting the hose.

13. The harness of claim 11, wherein said straps cross perpendicularly on the back of the wearer and are secured to each other at a common point.

14. The harness of claim 11, further comprising means for adjusting the length of said lanyard.

15. A firefighter's harness, comprising:

an adjustable chest belt having front, rear and left and right side portions;

a tongue and latch for receiving said tongue attached at opposite ends of said belt, said tongue and latch being readily releasable under tension;

a pair of shoulder straps crossing each other perpendicularly on the back and being fixedly attached to each other at said crossing, each of said shoulder straps including a front portion and a back portion attached respectively to said front and back portions of said belt;

a loop slideably positioned on said belt at a said side portion between a said front and a said back attachment of said straps;

an adjustable lanyard adapted to support loading from weight of a firehose and force from a nozzle discharging from the firehose;

a tongue affixed on said lanyard; and a latch including a push button actuator and being affixed to said loop for receiving said lanyard tongue, said tongue being readily releasable from said latch by mere pressure on said actuator when under said loading of said lanyard.

* * * * *